US005954292A

United States Patent [19]

Nawano et al.

[11] Patent Number: 5,954,292

[45] Date of Patent: Sep. 21, 1999

[54] METHOD AND APPARATUS FOR SPLICING WEB

[75] Inventors: Takashi Nawano; Nobuyuki Suzuki, both of Minami-Ashigara, Japan

[73] Assignee: Fuji Photo Film Co., Ltd., Kanagawa, Japan

[21] Appl. No.: 08/965,952

[22] Filed: Nov. 7, 1997

[30] Foreign Application Priority Data

Nov. 8, 1996 [JP] Japan ..... 8-296766

[51] Int. Cl.[6] ..... B65H 19/10; B65H 19/18; B65H 26/00

[52] U.S. Cl. ..... 242/554.4; 242/555.1; 242/563.1

[58] Field of Search ..... 242/554.4, 555.1, 242/563.1, 564.4

[56] References Cited

U.S. PATENT DOCUMENTS 3,654,035 4/1972 Takimoto ..... 156/505

FOREIGN PATENT DOCUMENTS 2 107 677 9/1971 Germany .

48-38461 11/1973 Japan .

49-12329 3/1974 Japan .

60-56614 12/1985 Japan .

2 286 181 9/1995 United Kingdom .

OTHER PUBLICATIONS

Patent Abstracts of Japan vol. 014, No. 447 (M–1029), Sep. 25, 1990, & JP 02 178153 A (CKD Corp) Jul. 11, 1990 *Abstracts.

*Primary Examiner*—John Q. Nguyen

*Attorney, Agent, or Firm*—Sughrue, Mion, Zinn, Macpeak & Seas, PLLC

[57] ABSTRACT

A web holding unit is provided just in front of a cutting and splicing unit. The holding unit is comprised mainly of multiple pass rollers, a pass roller motor, a vacuum pump, and an up/down cylinder. As the unwinding of an old web comes to an end, a rod of the up/down cylinder extends, and the pass rollers of the holding unit abut against the old web. The pass roller rotates at lower speed than web transport speed, and during the transport, the old web is drawn onto the pass rollers by sucking of the pump. The old web is transported to the cutting and splicing unit with a position thereof being regulated by the holding means.

8 Claims, 7 Drawing Sheets

METHOD AND APPARATUS FOR SPLICING WEB

BACKGROUND OF THE INVENTION

1. Field of the Invention

The present invention relates generally to a web splicing apparatus for splicing webs, and more particularly to a splicing method and apparatus for splicing ends of long flexible sheet materials such as plastic film, paper and foil (hereinafter referred to as "web") unwound from an old roll and a new roll.

2. Description of Related Art

U.S. Pat. No. 3,654,035, which corresponds to Japanese Patent Publication No. 48-38461, and Japanese Patent Publication No. 49-12329 disclose pieces of conventional web splicing apparatus consisting of a web turret, a web cutting and splicing unit, and so forth.

The turret has a turret arm, and an old roll and a new roll are pivotally supported by ends of the turret arm. The web is continuously supplied to the cutting and splicing unit by changing the positions of the old roll and the new roll. The cutting and splicing unit has a cutting drum and a splicing drum. The cutting drum cuts the trailing end of an old web which is being unwound from the old roll and the leading end of a new web which starts to be unwound from the new roll. The splicing drum splices the web ends with splicing tape.

Japanese Patent Publication No. 60-56614 discloses a web splicing apparatus in which a vacuum box is arranged between the turret arm and the cutting and splicing unit. In this web splicing apparatus, a scrap cut from the old web by the cutting and splicing unit is sucked into the vacuum box, and then the scrap is discharged to the outside of the vacuum box.

The above-described pieces of web splicing apparatus, however, have a disadvantage in that when the trailing end of the old web separates from the core of the old roll, the trailing end comes loose, and therefore a part of the old web from the trailing end to the cutting and splicing unit drifts. Consequently, when the trailing end of the old web reaches the web splicing position, the splicing does not take place at a proper position.

SUMMARY OF THE INVENTION

The present invention has been developed to eliminate the above-described disadvantages of the prior art and has as its main object the provision of a method and apparatus for splicing webs, which is able to correctly guide a trailing end of an old web unwound from an old roll to a splicing position.

To achieve the above-mentioned object, a web splicing method of the present invention for splicing a trailing end of an old web which is being unwound from an old roll and a leading end of a new web which starts to be unwound from a new roll, is characterized in that: a holding means for holding the old web is provided at an upstream side of a splicing position of the webs; and the holding means positions the old web so as to guide the trailing end of the old web separating from the old roll to the guide the trailing end of the old web separating from the old roll to the splicing position.

According to the present invention, the holding means holds the old web unwound from the old roll just before the trailing end of the old web separates from the old roll. Then, the trailing end of the old web is guided to the splicing position while the holding means positions the old web. Thus, in the present invention, the trailing end of the old web can be correctly guided to the splicing position.

Moreover, according to the present invention, the holding means consists of multiple pass rollers and a drawing means, and the old web is transported in a state of being drawn onto the pass rollers by the drawing means, that is, with the position thereof being regulated. Thus, the position of the old web can be regulated by a simple means.

Further, according to the present invention, at least one of the pass rollers are rotated at lower speed than transport speed of the old web. Thereby, the old web is transported with a tensile force being applied thereto, that is, with the position thereof being regulated. Therefore, the trailing end of the old web can be correctly guided to the splicing position.

Furthermore, the holding means is movable in the width direction of the old web. When the old web deviates from the proper position in the width direction of the old web with respect to the splicing position, the holding means moves in the width direction so as to correct the deviation. Thus, the old web can be correctly guided to the splicing position.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Detailed description will hereunder be given of preferable embodiments of the method and apparatus for splicing webs according to the present invention with reference to the accompanying drawings.

Figure 1:
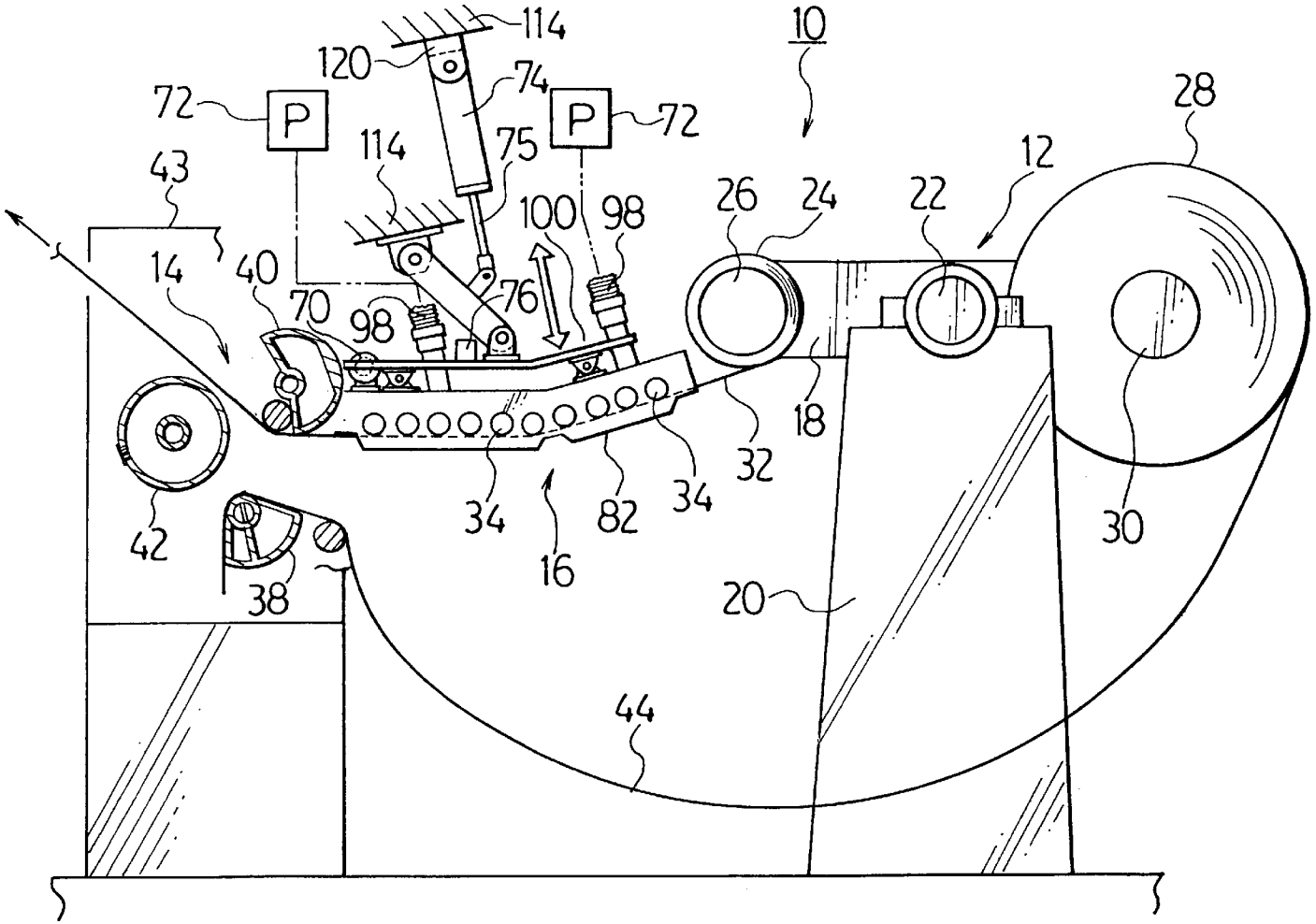
FIG. 1 is a view illustrating the structure of a web splicing apparatus according to the present invention.

FIG. 1 is a view illustrating a web butt splicing apparatus to which a web splicing apparatus of the present invention is applied. As shown in FIG. 1, the splicing apparatus 10 is comprised mainly of a turret 12, a web cutting and splicing unit 14, and a web holding unit (a holding means) 16.

The turret 12 has a turret arm 18, which is supported on a column 20 rotatably around a shaft 22. An old roll 24 which completes unwinding of an old web 32 is supported at one end of the turret arm 18 rotatably around a shaft 26. A new roll 28 which starts unwinding of a new web 44 is supported at the other end of the turret arm 18 rotatably around a shaft 30. The web 32 is supported on multiple pass rollers 34 of the web holding unit 16, and then the web 32 is transported to a rear take-up unit (not shown) via the web cutting and splicing unit 14.

Figure 2:
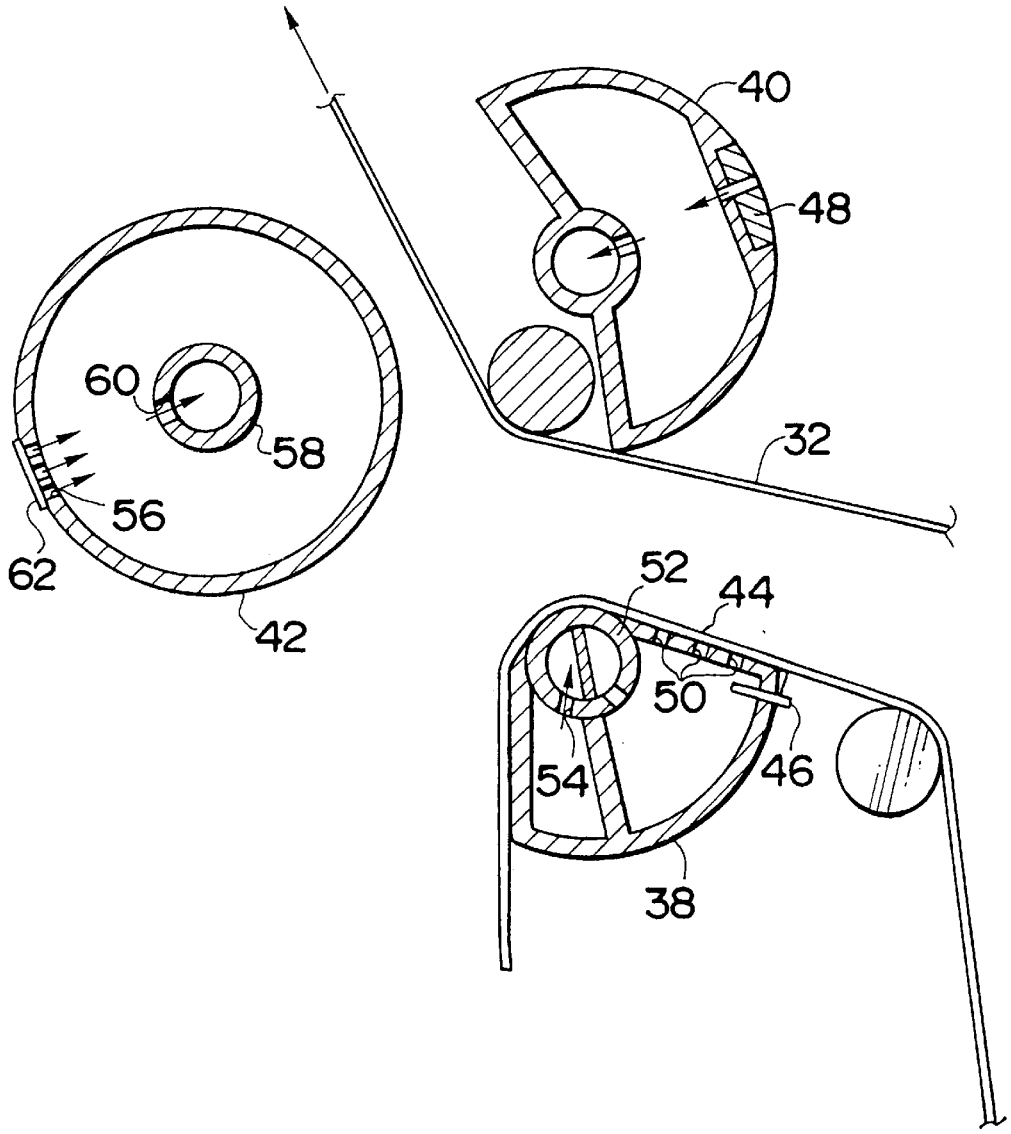
FIG. 2 is a view illustrating the structure of a web cutting and splicing unit.

As shown in FIG. 2, the web cutting and splicing unit 14 consists of a cutting drum 38, a cutting and splicing drum 40 and a splicing drum 42, all of which are mounted on a frame 43 shown in FIG. 1. These drums 38, 40, 42 are synchronously rotated by power from a drive motor (not shown). The web 32 is inserted into a space formed between the cutting drum 38 and the cutting and splicing drum 40 and the splicing drum 42, and then the web 32 is taken up by the take-up unit.

A web transporting unit (not shown) transports the leading end of the new web 44 to the web cutting and splicing unit 14. Then, the cutting drum 38 holds the new web 44 which is ready for splicing as shown in FIG. 2.

Figure 3:
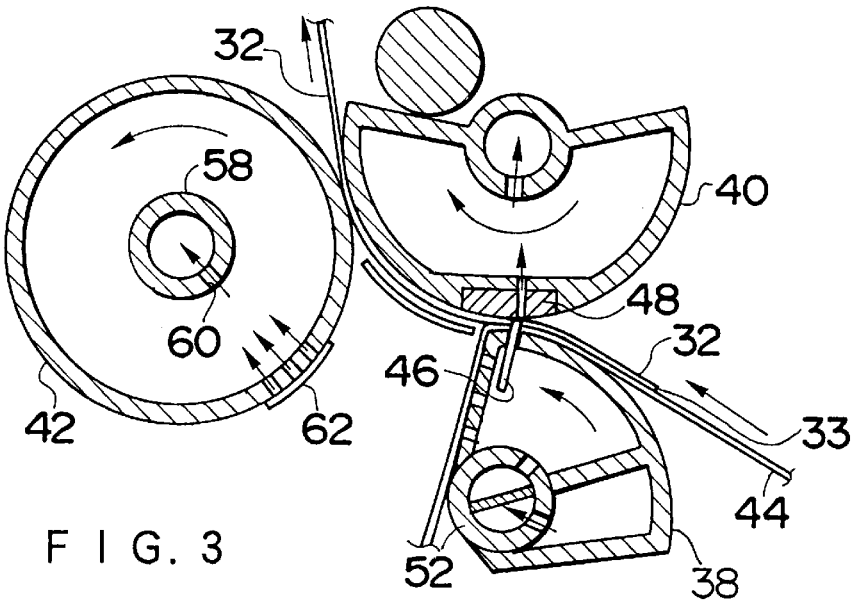
FIG. 3 is a view of assistance for explaining the operation of the cutting and splicing unit.
Figure 4:
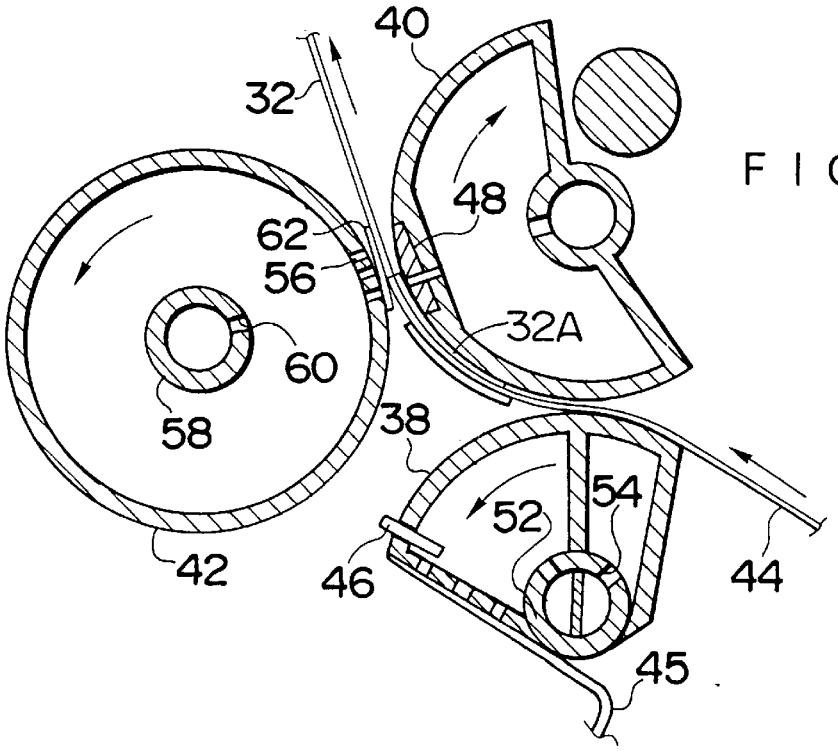
FIG. 4 is a view of assistance for explaining the operation of the cutting and splicing unit.

In FIG. 2, a cutter 46 is attached to the cutting drum 38. As shown in FIG. 3, the cutter 46 cuts the stacked webs 32, 44 on a cutting part 48 of the cutting and splicing drum 40. The cutter 46 is attached to the cutting drum 38 in such a state that the cutter 46 tilts a predetermined angle with respect to the width direction of the web in order to improve the sharpness. As shown in FIG. 2, ventholes 50 are formed in a flat surface of the cutting drum 38, and the ventholes 50 communicate with a venthole 54 formed in a rotary hollow shaft 52. The rotary hollow shaft 52 connects to a suction unit and a blow unit (not shown). When the suction unit is driven, the portion in proximity to the leading end of the new web 44 is held by the ventholes 50 as shown in FIG. 2, and when the blow unit is driven, a scrap 45 cut from the new web 44 in FIG. 4 is removed from the cutting drum 38.

Ventholes 56 are formed in the splicing drum 42, and the ventholes 56 communicate with a venthole 60 formed in a rotary hollow shaft 58. The rotary hollow shaft 58 connects to a suction unit (not shown). When the suction unit is driven, splicing tape 62 is held by the ventholes 56. The splicing tape 62 is automatically supplied from a splicing tape supply unit (not shown).

Figure 5:
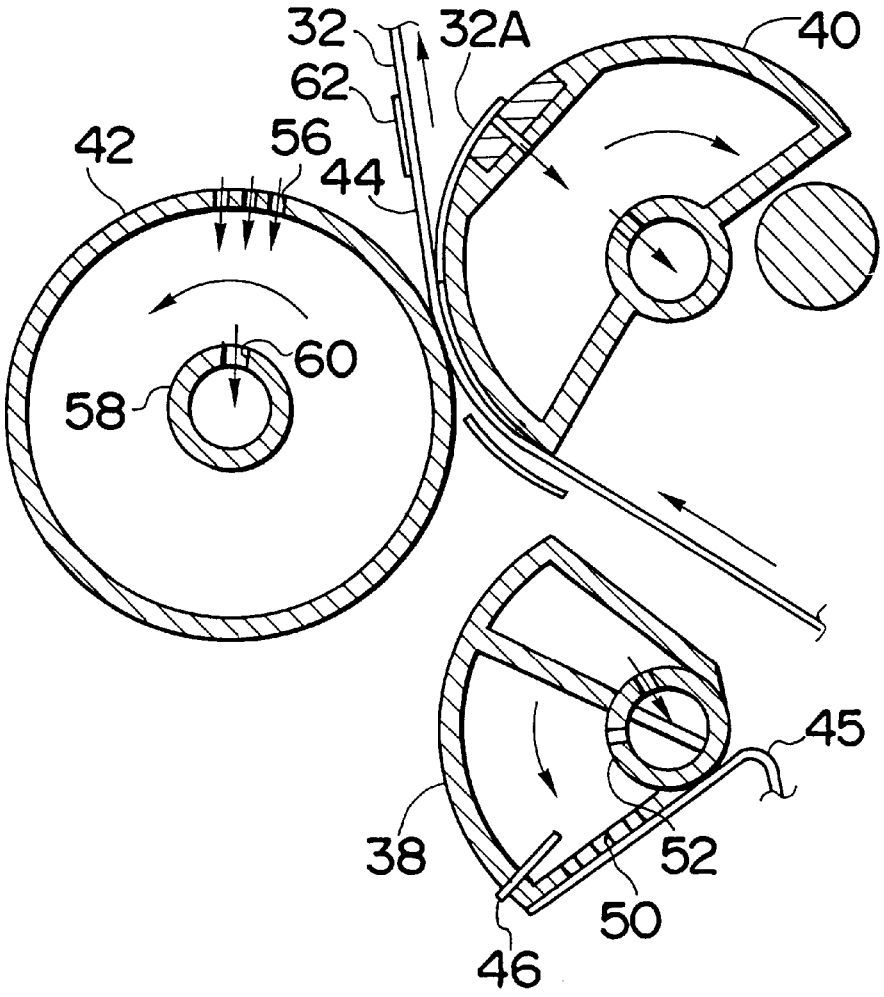
FIG. 5 is a view of assistance for explaining the operation of the cutting and splicing unit.

The web cutting and splicing unit 14 is controlled to be actuated when the trailing end 33 of the old web 32 (see FIG. 3) becomes close to the cutting and splicing unit 14. As shown in FIG. 3, the drums 38, 40, 42 are driven in directions indicated by arrows, and they cut the webs 32, 44 with the cutter 46 of the cutting drum 38 on the cutting part 48 of the cutting and splicing drum 40. Then, as shown in FIG. 4, the trailing end of the old web 32 and the leading end of the new web 44 are spliced together with the splicing tape 62, and the splicing tape 62 is pressed between the cutting and splicing drum 40 and the splicing drum 42. Thereby, the trailing end of the old web 32 and the leading end of the new web 44 are butted and spliced together with the splicing tape 62 as shown in FIG. 5. Thus, according to the cutting and splicing unit 14, the webs 32, 44 can be continuously unwound without stopping supplying the webs. Reference numeral 32A indicates a scrap cut from the old web 32.

Figure 6:
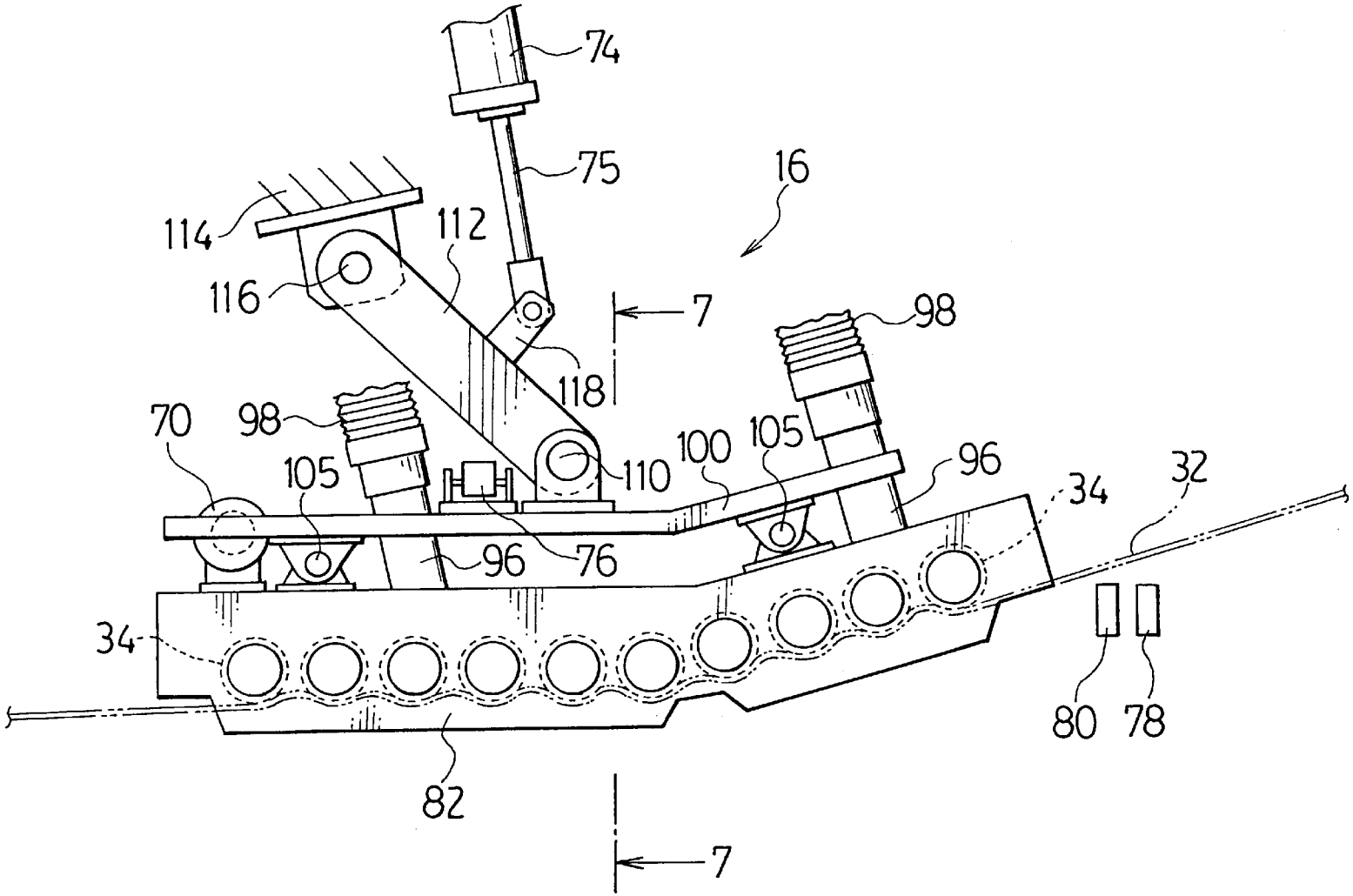
FIG. 6 is a side view of a web holding unit applied to the web splicing apparatus according to the present invention.

Description will hereunder be given of the web holding unit 16. FIG. 6 is a side view of the web holding unit 16, and FIG. 7 is a sectional view taken along line 7—7 of FIG. 6.

As shown in FIG. 1, the holding unit 16 is arranged at the upstream side of the cutting and splicing unit 14. The holding unit 16 is comprised mainly of the multiple pass rollers 34, which transport the web 32; a pass roller motor 70; vacuum pumps 72; a pair of up/down cylinders 74; and a slide cylinder 76. As shown in FIG. 6, at the upstream side of the holding unit 16, there are provided an end sensor 78, which detects the trailing end of the web 32, and a position sensor 80, which determines a position of the web 32 in the width direction of the web 32. The end sensor 78 is adjacent to the position sensor 80.

The pass rollers 34 are parallel with one another and perpendicular to a direction in which the web 32 is transported, and the pass rollers 34 are arranged at regular intervals in the direction in which the web 32 is transported. As shown in FIG. 7, a left end 34A of the pass roller 34 is rotatably supported on a left side wall 82A of a case 82 via a bearing 84. A right end 34B is rotatably supported on a right side wall 82B of the case 82 via a bearing 86.

Figure 7:
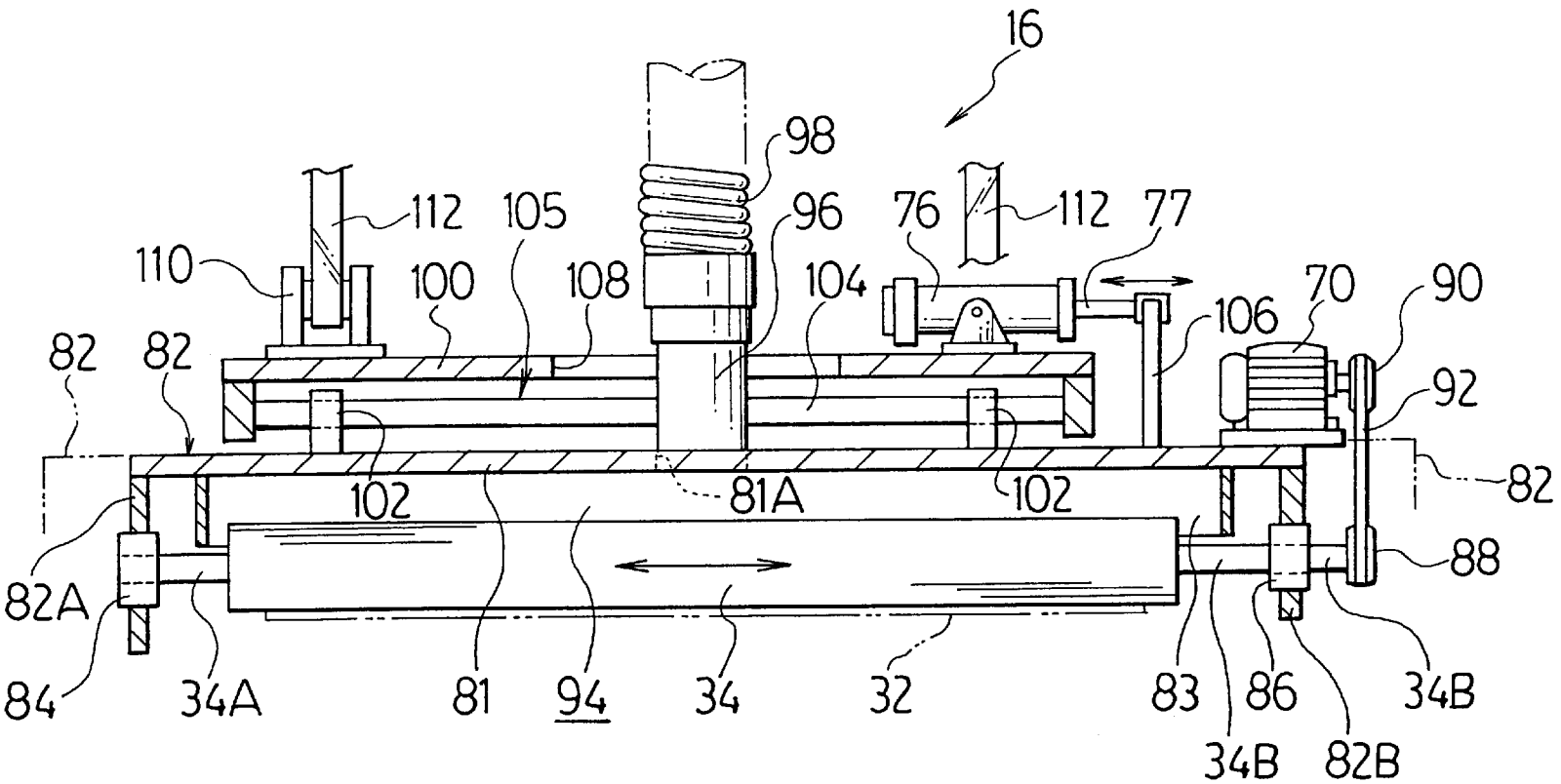
FIG. 7 is a sectional view taken along line 7—7 of FIG. 6.

As shown in FIG. 7, the right end 34B of the pass roller 34 passes through the bearing 86, and a pulley 88 is secured to the right end 34B. The pulley 88 connects to a pulley 90 of the pass roller motor 70 via a drive belt 92. A drive force of the motor 70 rotates the pass roller 34. The motor 70 is fixed on the case 82.

The case 82 is formed as a box without a bottom wall, which is composed of the above-mentioned left side wall 82A and right side wall 82B, and a front wall (not shown) and a back wall 83 which are secured to the upstream side and the downstream side, respectively, of a top wall 81 in parallel with the pass rollers 34. While the web 32 is transported on the pass rollers 34, it seems as if the web 32 were forming the bottom wall of the case 82, substantially sealing an interior space 94 in the case 82.

Holes 81A are respectively formed at the upstream side and the downstream side in the top wall 81 of the case 82, and they communicate with the interior space 94. The holes 81A connect to vacuum pipes 96 in FIG. 6, which connect to the above-mentioned vacuum pumps 72 (see FIG. 1) via flexible pipes 98. When driven, the vacuum pumps 72 suck in air from the interior space 94 in the case 82, and thereby make the interior space 94 negative pressure. Thus, the web 32 is drawn onto the pass rollers 34 while being transported to the cutting and splicing unit 14, that is, the position of the web 32 being transported is regulated.

In FIG. 7, a support plate 100 is provided on the case 82 via a pair of bearings 102 and a guide bar 104. The bearings 102 are secured to the top wall 81 of the case 82 in such a state that they are opposite to one another, and the guide bar 104 inserted into the bearings 102 is parallel with the pass rollers 34. Thereby, the case 82 is movable in the axial direction of the pass roller 34, that is, the width direction of the web 32.

The previously-mentioned slide cylinder 76 is mounted on the support plate 100. The cylinder 76 is a driver for moving the case 82 in the width direction of the web 32. The end of a rod 77 of the cylinder 76 is fixed on the top end of a post 106 vertically standing on the top wall 81 of the case 82. When the cylinder 76 extends and contracts the rod 77, the case 82 is moved in the width direction of the web 32. Slide mechanisms 105, each of which consists of the pair of the bearings 102 and the guide bar 104, are provided at two positions, that is, the upstream side and the downstream side as shown in FIG. 6. Reference numeral 108 in FIG. 7 is an opening formed in the support plate 100, and the vacuum pipe 96 connects to the hole 81 of the case 82 through the opening 108.

Bearings 110 (one is not illustrated) are secured to both sides at the center of the top surface of the support plate 100. The bottom ends of links 112 are rotatably supported on the bearings 110 as shown in FIG. 7, and the top ends of the links 112 are rotatably supported on bearings 116 fixed to a body 114. Bearings 118 (one is not illustrated) are secured to the center of the links 112. The ends of rods 75 of the up/down cylinders 74 are rotatably connected to the bearings 118. The tops of the up/down cylinders 74 are rotatably supported on bearings 120 (see FIG. 1) which are fixed to the body 114. When the rods 75 contract, the links 112 rotate counterclockwise in FIG. 6 around the bearings 116, thereby moving up the holding unit 16 farther away from the web 32. When the rods 75 extend, the links 112 rotate clockwise in FIG. 6, thereby moving down the holding unit 16 closer to the web 32.

Figure 8:
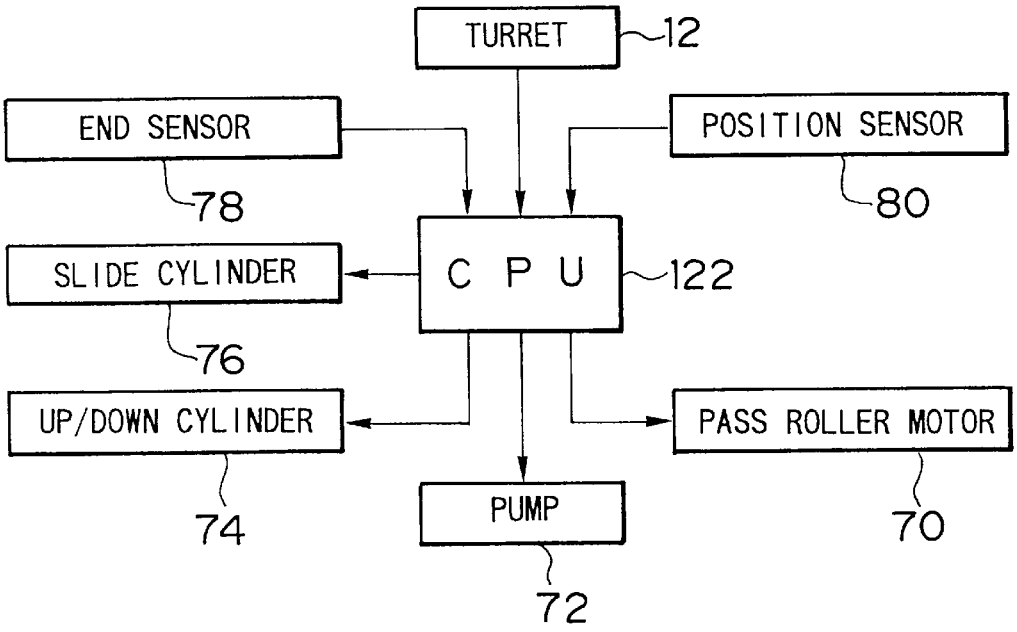
FIG. 8 is a block diagram illustrating a control system for the holding unit.

FIG. 8 is a block diagram illustrating a control system for the web holding unit 16. A central processing unit (CPU) 122 for controlling the holding unit 16 controls the driving of the pass roller motor 70, the pumps 72, the up/down cylinders 74 and the slide cylinder 76 according to signals output from the turret 12, the end sensor 78 and the position sensor 80.

Description will hereunder be given of the operation of the web holding unit 16 with reference to the control executed by the CPU 122.

While the old web 32 is unwound, the CPU 122 controls the up/down cylinders 74 to keep the rods 75 contracted. Since the holding unit 16 waits at a position retracted from the web 32, the web 32 can be continuously transported without receiving a transport resistance from the holding unit 16.

When the turret 12 outputs a signal indicating that the unwinding of the old web 32 comes to an end, the CPU 122 controls the up/down cylinders 74 to extend the rods 75. Thereby, the holding unit 16 moves to the web 32, and the pass rollers 34 of the holding unit 16 abut against the web 32.

Then, the CPU 122 controls the pass roller motor 70 so as to rotate the pass roller 34 in the same direction as the web transport direction at the same or lower speed than the web transport speed. At the same time, the CPU 122 drives the pumps 72 to suck in air from the interior space 94 in the case 82.

Thereby, the old web 32 is transported with a tensile force applied to a part of the web 32 between the holding unit 16 and the cutting and splicing unit 14 by the low-speed rotation of the pass roller 34. During the transport, the web 32 is drawn onto the pass rollers 34 by driving of the pumps 72. Thus, the web 32 is transported to the cutting and splicing unit 14 in such a state where the position of the transported web 32 is regulated by the holding unit 16.

In this embodiment, even if the trailing end of the old web 32 separates from the old roll 24, the trailing end does not come loose but is positioned by the holding means 16, thereby preventing the web 32 from drifting. Thus, according to this embodiment, the trailing end of the old web 32 can be correctly guided to the proper splicing position of the cutting and splicing unit 14.

The CPU 122 compares position data representing the position of the web 32 in the width direction of the web 32, which is output from the position sensor 80, with reference position data representing a proper position of the web 32 (data indicating the proper splicing position in the width direction of the web 32), which are previously stored in the CPU 122. If the determined position data of the web 32 deviates from the reference position data, the CPU 122 drives the slide cylinder 76 to move the case 82 in the width direction of the web 32, thereby moving the web 32 in the width direction in order to correct the deviation. Thus, the web 32 can be correctly guided to the splicing position.

When the end sensor 78 outputs a signal indicating the detection of the trailing end of the old web 32, the CPU 122 controls the up/down cylinders 74 to contract the rods 75 when the detected trailing end of the web 32 passes the holding unit 16. Thereby, the holding unit 16 moves up to the position retracted from the web 32, and it waits there until the turret 12 outputs a signal indicating that the unwinding of the next old web, that is, the web 44 is near completion.

Thus, in this embodiment, by repeating the above-stated steps for every splicing operation, the old web 32 and the new web 44 can be spliced together at a correct position.

As set forth hereinabove, in the splicing method and apparatus for splicing the webs according to the present invention, the holding means holds the old web being unwound from the old roll and guides the trailing end of the old web to the splicing position while positioning the old web. For this reason, the trailing end of the old web can be correctly guided to the splicing position.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. A web splicing method for splicing a trailing end of an old web which is being unwound from an old roll and a leading end of a new web which starts to be unwound from a new roll, wherein:

holding means for holding the old web is provided at an upstream side of a splicing position of the webs; and said holding means positions the old web so as to guide the trailing end of the old web separating from the old roll to the splicing position.

2. A web splicing apparatus for splicing a trailing end of an old web which is being unwound from an old roll and a leading end of a new web which starts to be unwound from a new roll, said apparatus comprising:

turret means for pivotally supporting the old roll and the new roll;

splicing means for splicing the trailing end of the old web and the leading end of the new web; and holding means for holding and positioning the old web so as to guide the trailing end of the old web separating from the old roll to said splicing means, said holding means provided at an upstream side of said splicing means.

3. The web splicing apparatus as defined in claim 2, wherein said holding means comprises:

multiple pass rollers for transporting the old web; and drawing means for drawing the old web onto said pass rollers by sucking in air through a gap between said pass rollers.

4. The web splicing apparatus as defined in claim 3, wherein said holding means further comprises driving means for rotating at least one of said pass rollers at a lower speed than a transport speed of the old web so as to apply a tensile force to a part of the old web between said holding means and said splicing means.

5. The web splicing apparatus as defined in claim 2, wherein said holding means is movable in a width direction of the old web.

6. The web splicing apparatus as defined in claim 2, further comprising:

a position sensor for determining a position of the old web in a width direction of the old web;

width direction movement means for moving said holding means in the width direction of the old web; and control means for controlling said width direction movement means according to the width directional position of the old web determined by said position sensor, thereby correcting deviation of the old web in the width direction with respect to said splicing means.

7. The web splicing apparatus as defined in claim 2, further comprising:

forward and backward movement means for moving said holding means forward and backward with respect to the old web; and control means for driving said forward and backward movement means so as to move said holding means to the old web when said turret means outputs a signal indicating that the unwinding of the old web comes to an end.

8. The web splicing apparatus as defined in claim 7, further comprising:

an end sensor for detecting the trailing end of the old web; and control means for driving said forward and backward movement means so as to move said holding means away from the old web when the detected trailing end of the old web passes said holding means.

* * * * *